US006360987B1

(12) United States Patent
Sallaee et al.

(10) Patent No.: US 6,360,987 B1
(45) Date of Patent: Mar. 26, 2002

(54) METHODS AND APPARATUS FOR SWASH PLATE GUIDANCE AND CONTROL

(75) Inventors: Bradley T. Sallaee, Austin; Ken Vinson, Coldspring, both of TX (US)

(73) Assignee: Bae Systems Integrated Defense Solutions, Austin, TX (US)

( * ) Notice: Subject to any disclaimer, the term of this patent is extended or adjusted under 35 U.S.C. 154(b) by 0 days.

(21) Appl. No.: 09/578,800

(22) Filed: May 23, 2000

(51) Int. Cl.[7] ..... F42B 10/02
(52) U.S. Cl. ..... 244/3.21; 244/3.23; 244/3.24
(58) Field of Search ..... 244/90 R, 3.23, 244/3.24, 3.22, 3.21; 416/98, 99, 108

(56) References Cited

U.S. PATENT DOCUMENTS

| | | | | |
|---|---|---|---|---|
| 2,654,334 A | | 10/1953 | Wheeler | 114/23 |
| 2,861,640 A | | 11/1958 | Du Pont | 170/160.13 |
| 3,355,130 A | * | 11/1967 | Dell | 244/3.24 |
| 3,464,650 A | | 9/1969 | Girard | 244/7 |
| 3,608,509 A | | 9/1971 | Brooks et al. | 114/23 |
| 4,073,600 A | | 2/1978 | Doman | 416/140 |
| 4,210,298 A | | 7/1980 | Liberman | 244/3.21 |
| 4,890,554 A | | 1/1990 | Schleimann-Jensen | 102/384 |
| 6,247,666 B1 | * | 6/2001 | Baker et al. | 244/3.21 |

* cited by examiner

*Primary Examiner*—Galen L. Barefoot
(74) *Attorney, Agent, or Firm*—Fulbright & Jaworski

(57) ABSTRACT

Apparatuses and methods for controlling an object spinning at a first rate in a first direction. The apparatus includes a swash plate, a rotor, a spin actuator, a roll actuator, and a pitch actuator. The rotor is coupled to the swash plate. The spin actuator is coupled to the rotor and is configured to spin the rotor in a second direction opposite the first direction at a second rate. The roll actuator is coupled to the rotor and is configured to displace the swash plate along a longitudinal axis. The pitch actuator is coupled to the rotor and is configured to tilt the swash plate in a tilt direction about the longitudinal axis, the tilt direction being adjustable by adjusting the second rate relative to the first rate. The roll actuator may be coupled to the pitch actuator so that the pitch actuator keeps a substantially identical orientation with the swash plate as the swash plate is displaced along the longitudinal axis by the roll actuator.

27 Claims, 3 Drawing Sheets

METHODS AND APPARATUS FOR SWASH PLATE GUIDANCE AND CONTROL

BACKGROUND OF THE INVENTION

1. Field of the Invention

The present invention relates generally to the fields of guidance and control actuators. More particularly, it concerns swash plate guidance and control actuators that may be used to guide and control spinning objects including missiles and projectiles.

2. Description of Related Art

Various means have been used to guide spinning objects such as non-spin stabilized missiles while in-flight toward their intended targets. A common means for accomplishing in flight guidance in the past has been to include adjustable fins, vanes or wing planes on the projectile. In the past, pneumatic and hydraulic control mechanisms or several electric motors were used to control each pair of wing planes. The problem with the aforementioned devices has been that generally one pneumatic or hydraulic cylinder or electric motor was required for each wing. The problem with the prior art control devices was that because of the plurality of prime movers required, they were complicated, expensive to manufacture, and frequently used an excessive amount of allocated space.

Additional problems and complications arise when trying to guide and control spin-stabilized objects. For high-spin-rate objects, one typically attempts to affect control by means of fins or the like. To make a lift maneuver in one direction for such objects, one must typically apply a sinusoidal lift direction into the fins at the spin rate of the object in order to induce a lift in one direction. This requires, in turn, that the bandwidth of the actuators be some multiple of the spin rate of the object. In fact, if multiple motions need to be applied to a spinning fin, it may be necessary to implement a control loop having a speed several times faster than the spin rate of the projectile.

Due to the high rate of objects such as missiles and rounds, the need to keep up with, and control, spinning fins necessitates very high bandwidth and often complicated actuators. Such actuators may be quite expensive and consume a lot of power—two factors that inhibit the ability to produce low-cost rounds. In fact, due to limited bandwidth, the maximum spin rate of a missile or round may be established, and indeed limited, by the point at which the actuator can no longer effectively control the missile.

In an attempt to address such limitations, others have designed products to de-spin objects to some reasonable rate that may be controlled by existing actuators. In fact, some have chosen to de-spin objects all the way down to a zero spin rate so that effective fin control may be more easily achieved. Although these approaches have exhibited some degree of utility, de-spinning an object is not always desirable. In particular, the de-spinning necessary to achieve control often sacrifices stability that could be provided by a higher, albeit uncontrollable spin rate. Further, de-spinning wastes critical time, which may limit the ability to steer to close-in targets.

In light of at least the above, methodology allowing for the control and guidance of highly spinning objects (such as missiles, rounds, munitions, projectiles, etc.) that is not unduly limited by actuator bandwidth would be advantageous. Particularly, methodology that reduces, or eliminates the need to de-spin an object in order to affect control would be most desirable.

SUMMARY OF THE INVENTION

In one respect, the invention is an apparatus for controlling an object spinning at a first rate in a first direction. The apparatus includes a swash plate, a rotor, a spin actuator, a roll actuator, and a pitch actuator. The rotor is coupled to the swash plate. The spin actuator is coupled to the rotor and is configured to spin the rotor in a second direction opposite the first direction. The roll actuator is coupled to the rotor and is configured to displace the swash plate along a longitudinal axis. The pitch actuator is coupled to the rotor and is configured to tilt the swash plate in a tilt direction about the longitudinal axis.

In other respects, the spin actuator may be configured to spin the rotor at a second rate substantially equal the first rate. The apparatus may also include one or more control rods coupled to the swash plate, the control rods being configured to couple to one or more guidance members of the object. The spin actuator may be configured to spin the rotor in the second direction at a third rate not equal to the second rate to adjust the tilt direction. The spin actuator may include a spin motor, a spin pinion coupled to the motor, a spin gear coupled to the pinion, and a spline drive coupled to the gear and to the rotor. The roll actuator may include a roll motor, a roll pinion coupled to the motor, a roll gear coupled to the pinion, and a roll drive screw coupled to the gear and to the rotor. The pitch actuator may include a pitch motor, a pitch pinion, a pitch gear coupled to the pinion, and a pitch bearing coupled to the gear and to the rotor. The pitch actuator may be coupled to a roll drive screw. The object may be a missile.

In another respect, the invention is an apparatus for controlling an object spinning at a first rate in a first direction, including a swash plate, a rotor, a spin actuator, a roll actuator, and a pitch actuator. The rotor is coupled to the swash plate. The spin actuator is coupled to the rotor and is configured to spin the rotor in a second direction opposite the first direction at a second rate. The roll actuator is coupled to the rotor and is configured to displace the swash plate along a longitudinal axis. The pitch actuator is coupled to the rotor and is configured to tilt the swash plate in a tilt direction about the longitudinal axis, the tilt direction being adjustable by adjusting the second rate relative to the first rate. The roll actuator is coupled to the pitch actuator so that the pitch actuator keeps a substantially identical orientation with the swash plate as the swash plate is displaced along the longitudinal axis by the roll actuator.

In other respects, the second rate may be substantially equal the first rate. The apparatus may also include one or more control rods coupled to the swash plate, the control rods being configured to couple to one or more guidance members of the object. The spin actuator may include a spin motor, a spin pinion coupled to the motor, a spin gear coupled to the pinion, and a spline drive coupled to the gear and to the rotor. The roll actuator may include a roll motor, a roll pinion coupled to the motor, a roll gear coupled to the pinion, and a roll drive screw coupled to the gear and to the rotor. The pitch actuator may include a pitch motor, a pitch pinion, a pitch gear coupled to the pinion, and a pitch bearing coupled to the gear and to the rotor. The roll actuator and the pitch actuator may be coupled to a roll drive screw. The object may be a missile.

In another respect, the invention is a method for controlling an object spinning at a first rate in a first direction. One or more guidance members of the object are coupled to a swash plate. A rotor coupled to the swash plate is spun in a second direction opposite the first direction at a second rate substantially equal the first rate. The swash plate is tilted about a longitudinal axis with a pitch actuator coupled to the rotor to affect a change in pitch of the object.

In other respects, the coupling may include coupling one or more fins to one or more control rods coupled to the swash plate. The method may also include displacing the swash plate along a longitudinal axis with a roll actuator to affect a change in the first rate. The displacing of the swash plate does not, in one embodiment, substantially affect the orientation of the pitch actuator with the swash plate. The object may be a missile.

In another respect, the invention is a method for controlling an object spinning at a first rate in a first direction. One or more guidance members of the object are coupled to a swash plate. A rotor coupled to the swash plate is spun in a second direction opposite the first direction at a second rate. The swash plate is tilted in a first tilt direction about a longitudinal axis with a pitch actuator coupled to the rotor to affect a first change in pitch of the object. The rotor is spun in the second direction at a third rate to adjust the first tilt direction to a second tilt direction about the longitudinal axis. The swash plate is tilted in the second tilt direction with the pitch actuator to affect a second change in pitch of the object.

In other respects, the coupling may include coupling one or more fins to one or more control rods coupled to the swash plate. The method may also include displacing the swash plate along a longitudinal axis with a roll actuator to affect a change in the first rate. The displacing of the swash plate does not, in one embodiment, substantially affect the orientation of the pitch actuator with the swash plate. The object may be a missile.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

The present disclosure addresses many, if not all, of the limitations mentioned above by providing for methods and apparatuses that allow for the control and guidance of highly spinning objects, while not being unduly limited by actuator bandwidth. In fact, the methods and apparatuses described herein may use low bandwidth actuators and low bandwidth control systems to control highly-spinning objects. Correspondingly, the present disclosure may reduce, or eliminate completely, the need to de-spin an object in order to affect control. In one embodiment, such advantages are accomplished by de-coupling the spin rate of the object being controlled from the bandwidth of the actuator and the control loop—by making the two independent, low-bandwidth actuators may be used. Additionally, the methodology of the present disclosure is advantageous in that it may be implemented with less cost and complexity than previous methods.

Although the applications of the present disclosure are vast, in one embodiment, the disclosed methods and apparatuses may be used to guide and control highly spinning rounds, which may spin at rates anywhere from about 0 to about 10,000 rotations per minute. In other embodiments, the present disclosure may be used to aid in the control of missiles, munitions, artillery shells, bullets, and the like.

Figure 1:
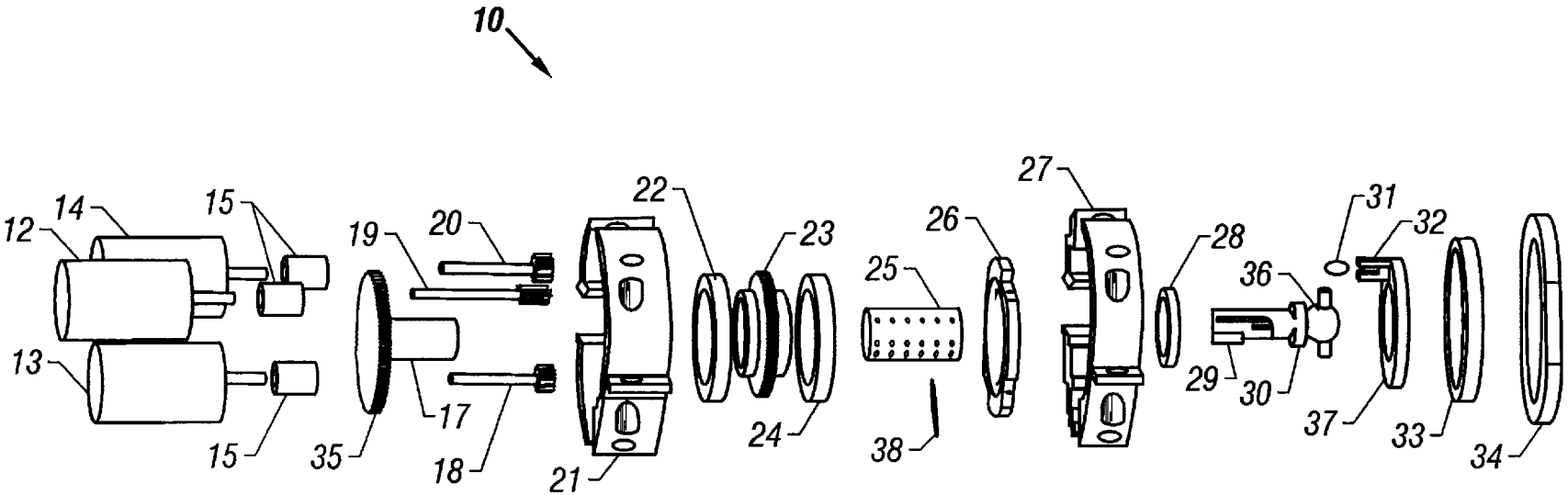
FIG. 1 shows an assembly view of swash plate control apparatus according to one embodiment of the present disclosure.

Turning first to FIG. 1, there is a shown an assembly view of a swash plate control apparatus 10 according to one embodiment of the present disclosure. Shown are pitch motor 12, spin motor 13, roll motor 14, collars 15, spin gear 35, spin bearing 16, spline drive mating gear 17, spin pinion 18, pitch pinion 19, roll pinion 20, rear housing 21, first roll bearing 22, roll gear 23, second roll bearing 23, roll drive screw 25, antirotation pin 38, pitch gear 26, front housing 27, pivot ball retainer 28, spline drive 29, spline bearing 30, pitch bearing 31, rotor 32, rotor bearing 33, and swash plate 34.

In the illustrated embodiment, spin motor 13 is coupled to spin pinion 18 (through collar 15), which is in turn coupled to spin gear 35. Although spin motor 13 may be any motor suitable for rotating spin pinion 18, in one embodiment, it may be a motor of about 12 Watts average power. It may be either a brush or brush-less permanent magnet DC servo motor. Spin pinion 18 engages spin gear 35, which translates spinning motion through spin bearing 16 to spline drive mating gear 17. Spline drive mating gear 17 is coupled to spline drive 29, which translates the spinning motion through spline bearing 30 to ball 36, which in turn couples to rotor 32 through opening 37 and pivot ball retainer 28. In one embodiment, these components collectively form a spin actuator coupled to rotor 32 and are configured to spin rotor 32. Optional anti-rotation pin 38 may be utilized to remove bearing drag torque between spinning parts of the swash plate control apparatus 10. For instance, pin 38 may remove drag torque, for instance, between rotor 32 and swash plate 34. Although described in terms of these specific components, those having skill in the art understand that countless other mechanical and/or electronic arrangements may be used to achieve a spin actuator coupled to and configured to spin rotor 32. All such arrangements fall within the spirit and scope of this disclosure.

In the illustrated embodiment, roll motor 14 is coupled to roll pinion 20 (through collar 15), which is in turn coupled to roll gear 23. Although roll motor 14 may be any motor suitable for rotating roll pinion 20, in one embodiment, it may be a motor of about 24 Watts average power. It may be either a brush or brush-less permanent magnet DC servo motor. Roll pinion 20 engages roll gear 35, which translates its motion through roll bearing 24 to roll drive screw 25, which converts the motion of the gear to translational motion. Roll drive screw 25 is coupled to spline drive 29, which translates the translational motion through rotor 32 and rotor bearing 33 to swash plate 34. In this embodiment, these components collectively form a roll actuator coupled to rotor 32 and are configured to displace swash plate 34 along a longitudinal axis. The longitudinal axis, in this illustration, runs through FIG. 1 generally from left to right from the motors 12, 13, and 14 to the swash plate 34. Thus, displacement along the longitudinal axis in the illustrated embodiments may be represented by moving swash plate 34 to the left or right. Although described in terms of these specific components, those having skill in the art understand that countless other mechanical and/or electronic arrangements may be used to achieve a roll actuator coupled to rotor 32 and configured to translate swash plate 34 along the longitudinal axis. All such arrangements fall within the spirit and scope of this disclosure.

In the illustrated embodiment, pitch motor 12 is coupled to pitch pinion 19 (through collar 15), which is in turn coupled to pitch gear 26. Although pitch motor 12 may be any motor suitable for rotating pitch pinion 19, in one embodiment, it may be a motor of about 24 Watts average power. It may be either a brush or brush-less permanent magnet DC servo motor. Pitch pinion 19 engages pitch gear 26, which translates its motion through roll to pitch bearing 21. Pitch bearing 21, which may also be referred to as a swash plate cam follower, is coupled to rotor 32 (via the rectangular protrusion on rotor 32), which is in turn coupled to swash plate 34. Pitch bearing 21, which may be shaped with various degrees of slope according to a desired range of motion, rotates and consequently displaces swash plate 34 according to the shape of pitch bearing 31. Hence, pitch bearing 31 acts as a swash plate cam follower. In one embodiment, pitch bearing 31 may be designed so that upon rotation of pitch gear 25, pitch bearing 31 may exert a force onto rotor 32 and swash plate 34. In the illustrated embodiment, such a force causes swash plate 34 to tilt in a tilt direction about the longitudinal axis. More particularly, considering the orientation of the pitch bearing 31 with respect to the rotor 32 and swash plate 34 (in FIG. 1, the pitch bearing 31 is oriented so that it will "push" on the upper part—specifically, the 12 o'clock position—of rotor 32 and swash plate 34), the tilting direction is such that the top of swash plate 34 is tilted outward while the bottom is tilted inward. In this embodiment, the components described above collectively form a pitch actuator coupled to rotor 32 and are configured to tilt the swash plate 34 in a tilt direction about the longitudinal axis. Although described in terms of these specific components, those having skill in the art understand that countless other mechanical and/or electronic arrangements may be used to achieve a pitch actuator coupled to rotor 32 and configured to tilt the swash plate 34. All such arrangements fall within the spirit and scope of this disclosure.

Figure 3:
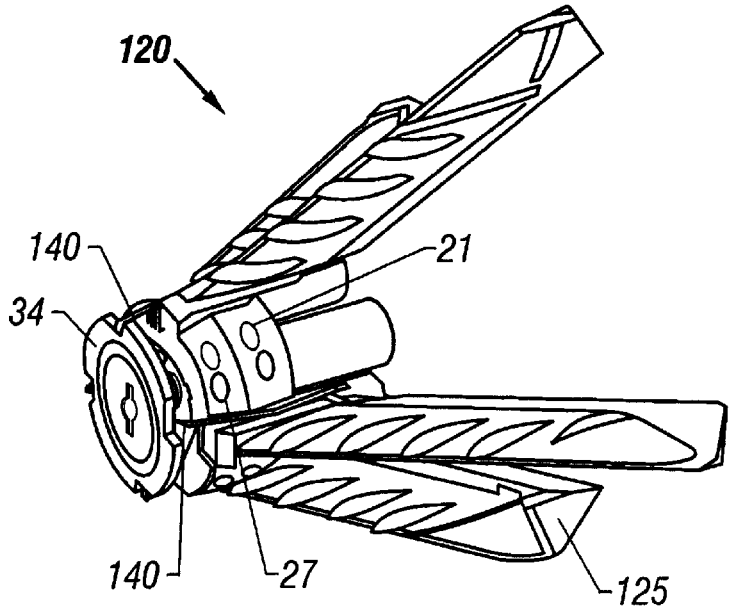
FIG. 3 shows a swash plate control apparatus coupled to open fins of a missile according to one embodiment of the present disclosure.
Figure 4:
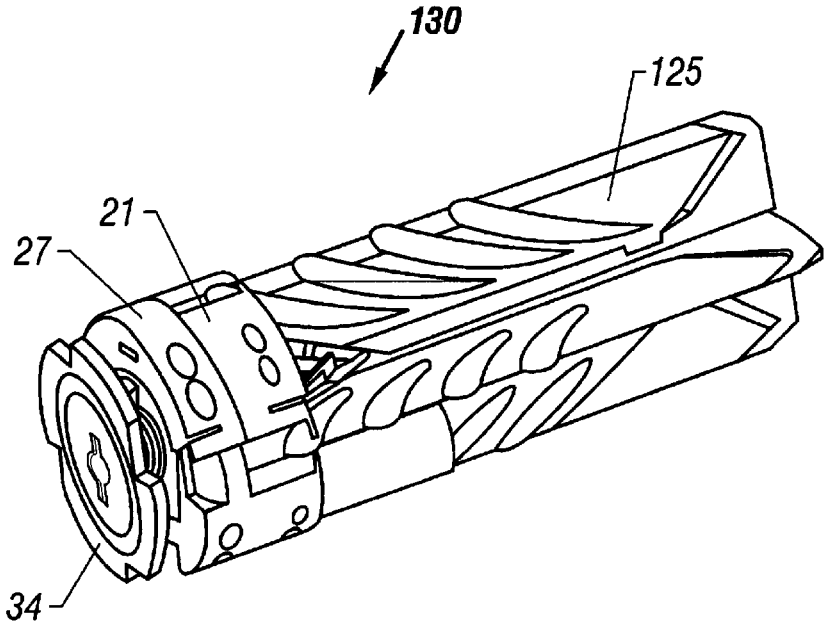
FIG. 4 shows a swash plate control apparatus coupled to closed fins of a missile according to one embodiment of the present disclosure.

Turning to FIGS. 3 and 4, it may be seen that one or more control rods 140 may be coupled to swash plate 34. These control rods 140 may be coupled to one or more guidance members 125 of a spinning object, such as a missile. In the illustrated embodiments of FIGS. 3 and 4, missiles 120 and 130 are shown, each of which contains four control members, fins in this case, coupled to four control rods 140 (not each one visible) of swash plate 34. With the benefit of the present disclosure, however, those having skill in the art recognize that more or fewer control rods may be utilized. Further, it will be understood that the design and composition of the control rods (and guidance members) may all vary widely and still create a suitable coupling from apparatus 10 to a spinning object.

FIGS. 3 and 4 also illustrate that housings 21 and 27 may be used to cover and protect the inner-workings of swash plate control apparatus 10. These housings may be made of any material suitable to protect the components of the apparatus. In one embodiment, the housings may be made from aluminum or from reinforced thermoplastic materials.

In operation, and according to one embodiment, swash plate control apparatus 10 operates to effectively de-couple the spin of an object being controlled from a control mechanism of the controlling actuator. Simply put, apparatus 10 allows for the control of a highly-spinning object without the need for a high-bandwidth actuator having a speed that matches, or exceeds, the spin rate of the object. In the illustrated embodiments, this is accomplished through the use of numerous mechanical components, which are illustrated in FIGS. 1 and 2.

Figure 2:
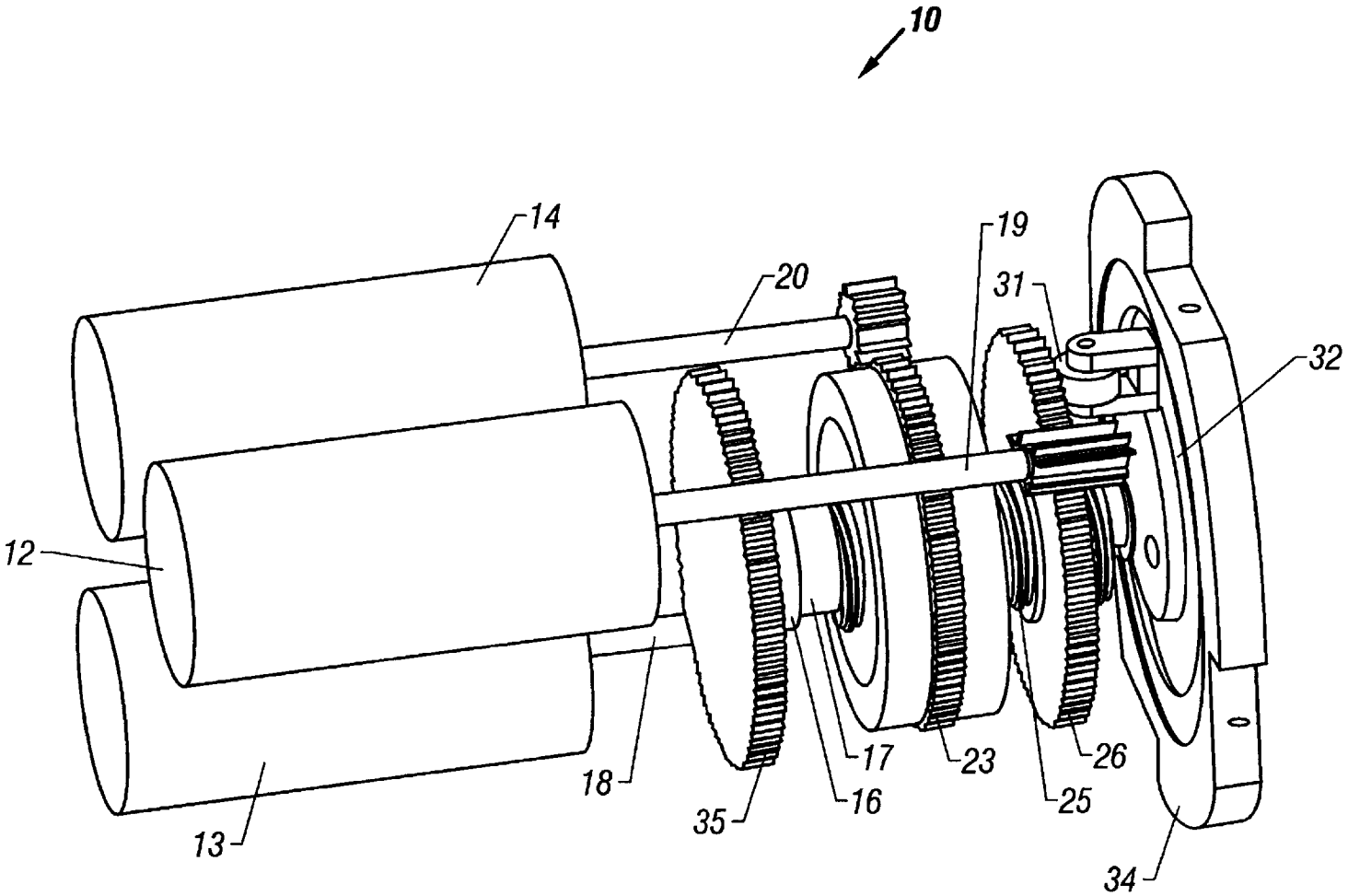
FIG. 2 shows a perspective side view of a swash plate control apparatus according to one embodiment of the present disclosure.

With reference to FIGS. 2 and 3, it may be seen how the de-coupling mentioned above may be accomplished. In one embodiment, actuator control may be de-coupled from the spin of the controlled object by keeping rotor 32, and pitch bearing 31 fixed, or substantially fixed, in inertial space. With these being fixed, the spinning object may be controlled by actuating bearing 31 regardless of the rotation rate of the spinning object. In other words, control of the spinning object may be rendered independent of the spin rate by "canceling-out" the spin of the spinning object and keeping rotor 32 and bearing 31 fixed.

In the illustrated embodiments, the spin cancellation is achieved via the spin actuator. In particular, as may be seen with reference to FIG. 2, spin motor 13 and spin pinion 18 may be used to rotate spin gear 35, which is coupled to rotor 32 (via the various parts illustrated in FIG. 1). Rotor 32 is coupled to swash plate 34, which may be coupled to a spinning object, a portion of which is illustrated in FIGS. 3 and 4. In one embodiment, the spin actuator of FIGS. 1 and 2 may be configured to spin rotor 32 in a direction opposite to the direction of the spin of the spinning object, at a rate substantially equal to the spin-rate of the spinning object. In a simplified example, if the spinning object were spinning at 10,000 rotations per minute in a clockwise direction, spin actuator may drive rotor 32 counter-clockwise at about 10,000 rotations per minute. In such an example, one viewing the system (spinning object plus control apparatus 10) would note that rotor 32 and bearing 31 would be fixed, or substantially fixed. In other words, rotor 32 and bearing 31 may be made fixed in inertial space by "canceling-out" the spin of the object—the "canceling out" may be done by spinning rotor 32 opposite to the spinning object at a rate equal to, or substantially equal to, the rate of spin of the object.

In one embodiment, the spin actuator of FIGS. 1 and 2 may drive rotor 32 opposite to the spin of the spinning object through the use of an inertial guidance system of the type known in the art (not shown). In such an embodiment, the inertial guidance system may measure the spin-rate of the spinning object, communicate that rate to the control mechanism for spin motor 13, which may then be driven so that rotor 32 matches the rate of the spinning object in an opposite direction. With the benefit of the present disclosure, those having skill in the art understand that various technology known in the art may be utilized to achieve this opposite spin-matching of rotor 32. All such techniques fall within the scope and spirit of this disclosure.

With rotor 32 and bearing 31 fixed, or substantially fixed, in inertial space, at least two fundamental control operations may be applied to a spinning object coupled to swash plate 34 regardless of the spin-rate of that object—roll and pitch. To affect a change in roll, swash plate 34 may be displaced along its longitudinal axis. With reference to FIGS. 3 and 4, this may be seen to affect the degree to which guidance members 125 are open or closed. This in turn, may affect the spin rate of the spinning object. Thus, by laterally displacing swash plate 34, the spinning object may be spun or de-spun. To displace swash plate 34 along the longitudinal axis, roll motor 14 may drive roll gear 23 to displace roll drive screw 25, which is coupled to rotor 32. Roll drive screw 25 engages rotor 32 to displace it along a longitudinal axis. With reference to FIG. 2, roll drive screw 25 displaces rotor 32, and correspondingly swash plate 34, to the left or right (away from or towards roll drive motor 14). This motion affects the roll of the spinning object. As understood by those having skill in the art with the benefit of this disclosure, the rate of change (and direction) of roll may be adjusted by adjusting any one or all of roll motor 14, roll pinion 20, roll gear 23, and/or roll drive screw 25.

To affect a change in pitch, swash plate 34 may be tilted relative to the longitudinal axis. To tilt swash plate 34, pitch motor 12 may drive pitch gear 26 to rotate pitch bearing 31, the swash plate cam follower. Due to the shape of pitch bearing 31, which may be elliptical or any other shape suitable to cause a displacement, rotor 32 may be tilted inward or outward relative to the longitudinal axis. This motion, due to the coupling between swash plate 34 and one or more guidance members (which may be accomplished via control rods 140 of FIGS. 3 and 4) affects the pitch of the spinning object. In the illustrated embodiment of FIG. 2, pitch bearing 31 is positioned at a 12 o'clock position in an inertial frame of reference. In this position, the tilt to the swash plate 34 is such that the 12 o'clock and 6 o'clock positions of swash plate 34 may be tilted inward and/or outward. Such tilting (and other tiltings about different axes) may be used to apply a lift vector to the spinning object being controlled. In one embodiment, such a lift vector may be used to achieve lift in a single, constant direction.

To tilt other positions of swash plate 34, several different embodiments may be utilized. In one embodiment, an additional pitch motor, pitch pinion, and pitch bearing or the like (not shown) may be used. For instance, an additional pitch motor may be used to engage an additional pitch bearing, similar to bearing 31 but located at a different position relative to swash plate 34. In particular, an additional pitch bearing may be located, for instance, at the 3 o'clock position of swash plate 34. In such a position, two orthogonal tilt directions may be achieved with the swash plate control apparatus 10. More particularly, pitch bearing 31 may control vertical tilt, while the additional pitch bearing (not shown) may control horizontal tilt. Using appropriate combinations of the two, any change in pitch may be achieved. With benefit of the present disclosure, those having skill in the art recognize that the present disclosure is not limited to only two pitch bearings, nor is it limited to bearings located at 12 o'clock and/or 3 o'clock positions. Rather, any arbitrary number of pitch actuators may be used, and those actuators may be positioned anywhere along rotor 32.

In another embodiment, single pitch bearing 31 may be used to achieve any arbitrary pitch direction. In such an embodiment, one may re-position pitch bearing 31 relative to swash plate 34 by adjusting the spin rate of rotor 32 relative to swash plate 34 via the spin actuator, which includes spin motor 13 in the illustrated embodiment. In particular, instead of canceling out the spin of the spinning object by matching the spin of that object (in the opposite direction), spin motor 13 may be configured to adjust the rotation speed of rotor 34 so that pitch bearing 31 moves relative to swash plate 34. For instance, spin motor 13 may initially rotate rotor 32 at a rate equal to the rate of the spinning object so that pitch bearing 31 remains fixed, in inertial space, at 12 o'clock relative to the swash plate 34. One or more pitch adjustments to the spinning object may be made from that position by tilting the swash plate 34. At a different time, spin motor 13 may momentarily slow down (or speed up) so that pitch bearing 31 moves in inertial space from its 12 o'clock position. For example, spin motor 13 may adjust the rotation rate of rotor 32 so that pitch bearing 31 rotates to a 3 o'clock position relative to swash plate 34. Once rotated to the desired position, spin motor 13 may then match the spin rate of the spinning object once again so as to fix the rotor 32 and pitch bearing 31 in inertial space (at 3 o'clock in this example). From this new position, one or more additional pitch adjustments may be made by tilting the swash plate 34.

With the ability to adjust the relative position of pitch bearing 31 with swash plate 34, any arbitrary change in pitch may be achieved simply by adjusting, momentarily, the speed of rotation of rotor 32. In other words, pitch bearing 31 may be gradually (or suddenly) moved from 12 o'clock to 3 o'clock (relative to the inertial frame of reference), making pitch adjustments (by tilting the swash plate 34) to the spinning object. This ability provides for significant advantages, including but not limited to ability to continuously adjust the pitch direction of a highly-spinning object in a high-g lift maneuver so that a constant lift with slight or no variation in direction may be achieved. Similarly, this ability allows for the trajectory of a highly spinning object to be continuously controlled and adjusted regardless of the spin rate, due to the effective de-coupling of actuator control and spin rate. This implementation also has the significant advantage of using, in one embodiment, three actuators instead of four because the cost of the actuators may dominate the cost of the other components.

As understood by those having skill in the art with the benefit of this disclosure, the change in pitch discussed above may be carried forth by adjusting any one or all of spin motor 13, spin pinion 18, spin gear 35, and/or pitch bearing 31.

In one embodiment, the roll actuator may be coupled to the pitch actuator so that the pitch actuator keeps a substantially identical orientation with the swash plate 34 as it is displaced along the longitudinal axis. This coupling may allow for an adjustment in roll without affecting the pitch of the spinning object being controlled by apparatus 10. More particularly, if coupled so that pitch actuator keeps a constant orientation with swash plate 34 during longitudinal displacements, the pitch actuator will not tilt the swash plate during roll maneuvers. In the embodiment illustrated in FIG. 2, it may be seen that this coupling may be done by coupling the pitch actuator to roll drive screw 25. In particular, screw gear 26 may sit atop roll drive screw 25 so that when swash plate 34 is displace longitudinally (via the roll actuator), pitch gear 26 and pitch pinion 19 follows. Thus, even when being longitudinally displaced, swash plate 34 is not inadvertently tilted. Thus, pitch may remain constant even during roll adjustments.

Further, this feature allows for pitch adjustments to be made simultaneous with roll adjustments. In particular, even while swash plate 34 is being displaced longitudinally, pitch motor 12 may drive pitch pinion 19 to drive turn pitch gear 26 to engage pitch pinion 31 to tilt swash plate 34. Note the long toothed portion of pitch pinion 19 allows for the engagement of spin gear 26 even if pitch gear 26 is displaced away from or towards spin motor 12. Because the pitch actuator keeps a substantially identical orientation with swash plate 34 as it is displaced longitudinally, there is no need to carry out pitch maneuvers any differently depending on whether or not a roll maneuver is being performed simultaneously. This provides for several distinct advantages including added versatility and simplicity during all types of trajectory modifications.

Although embodiments described above may utilize the spinning of rotor 32 at a rate substantially identical to, but in the opposite direction from, the spinning object being controlled to achieve a pitch actuator fixed in inertial space, those having skill in the art understand that the present disclosure offers significant advantages even if rotor 32 does not perfectly "cancel-out" the spin of the spinning object. This is true because as long as rotor 32 is being spun in a direction opposite to the spinning object, actuator control is at least partially de-coupled from the spin rate of the spinning object, regardless of the actual spin rate of the rotor 32. In particular, even if rotor 32 is counter-rotated at a rate one-half that of the spinning object, the present disclosure allows for the reduction in required actuator bandwidth by a factor of two because, in an inertial frame, the actuator controls are effectively rotating at a rate one-half the rate of the spinning object. Again, like the specific embodiments described above, this may allow for the control and guidance of the spinning object with low bandwidth actuators and may reduce or eliminate the need to de-spin a spinning object in order to have the ability to control or guide it.

All of the methods and apparatuses disclosed and claimed herein can be made and executed without undue experimentation in light of the present disclosure. While the methods and apparatuses of this invention have been described in terms of specific embodiments, it will be apparent to those of skill in the art that variations may be applied to the techniques described herein and without departing from the concept, spirit and scope of the invention. For example, it will be understood that the components illustrated in FIGS. 1–4 may be made of various materials as is known in the art. The methods for coupling components together may be any method known in the art including, but not limited to pins, screws, clips, and the like. The size of the different components may vary widely in size as is known in the art. For instance, one having skill in the art understands that apparatus 10 may range in size anywhere from about one inch to greater than 12 inches, scaling with the diameter of the projectile to be guided. All similar substitutes and modifications apparent to those skilled in the art are deemed to be within the spirit, scope and concept of the invention as defined by the appended claims.

What is claimed is:

1. An apparatus for controlling an object spinning at a first rate in a first direction, comprising:

a swash plate;

a rotor coupled to the swash plate;

a spin actuator coupled to the rotor and configured to spin the rotor in a second direction opposite the first direction;

a roll actuator coupled to the rotor and configured to displace the swash plate along a longitudinal axis; and a pitch actuator coupled to the rotor and configured to tilt the swash plate in a tilt direction about the longitudinal axis.

2. The apparatus of claim 1, wherein the spin actuator is configured to spin the rotor at a second rate substantially equal the first rate.

3. The apparatus of claim 1, further comprising one or more control rods coupled to the swash plate, the control rods being configured to couple to one or more guidance members of the object.

4. The apparatus of claim 1, the spin actuator being configured to spin the rotor in the second direction at a third rate not equal to the second rate to adjust the tilt direction.

5. The apparatus of claim 1, wherein the spin actuator comprises:

a spin motor;

a spin pinion coupled to the motor;

a spin gear coupled to the pinion; and a spline drive coupled to the gear and to the rotor.

6. The apparatus of claim 1, wherein the roll actuator comprises:

a roll motor;

a roll pinion coupled to the motor;

a roll gear coupled to the pinion; and a roll drive screw coupled to the gear and to the rotor.

7. The apparatus of claim 1, wherein the pitch actuator comprises:

a pitch motor;

a pitch pinion;

a pitch gear coupled to the pinion; and a pitch bearing coupled to the gear and to the rotor.

8. The apparatus of claim 1, wherein the pitch actuator is coupled to a roll drive screw.

9. The apparatus of claim 1, wherein the object is a missile.

10. An apparatus for controlling an object spinning at a first rate in a first direction, comprising:

a swash plate;

a rotor coupled to the swash plate;

a spin actuator coupled to the rotor and configured to spin the rotor in a second direction opposite the first direction at a second rate;

a roll actuator coupled to the rotor and configured to displace the swash plate along a longitudinal axis; and a pitch actuator coupled to the rotor and configured to tilt the swash plate in a tilt direction about the longitudinal axis, the tilt direction being adjustable by adjusting the second rate relative to the first rate;

wherein the roll actuator is coupled to the pitch actuator so that the pitch actuator keeps a substantially identical orientation with the swash plate as the swash plate is displaced along the longitudinal axis by the roll actuator.

11. The apparatus of claim 10, wherein the second rate is substantially equal the first rate.

12. The apparatus of claim 10, further comprising one or more control rods coupled to the swash plate, the control rods being configured to couple to one or more guidance members of the object.

13. The apparatus of claim 10, wherein the spin actuator comprises:

a spin motor;

a spin pinion coupled to the motor;

a spin gear coupled to the pinion; and a spline drive coupled to the gear and to the rotor.

14. The apparatus of claim 10, wherein the roll actuator comprises:

a roll motor;

a roll pinion coupled to the motor;

a roll gear coupled to the pinion; and a roll drive screw coupled to the gear and to the rotor.

15. The apparatus of claim 10, wherein the pitch actuator comprises:

a pitch motor;

a pitch pinion;

a pitch gear coupled to the pinion; and a pitch bearing coupled to the gear and to the rotor.

16. The apparatus of claim 10, wherein the roll actuator and the pitch actuator are coupled to a roll drive screw.

17. The apparatus of claim 10, wherein the object is a missile.

18. A method for controlling an object spinning at a first rate in a first direction, comprising:

coupling one or more guidance members of the object to a swash plate;

spinning a rotor coupled to the swash plate in a second direction opposite the first direction at a second rate substantially equal the first rate; and tilting the swash plate about a longitudinal axis with a pitch actuator coupled to the rotor to affect a change in pitch of the object.

19. The method of claim 18, wherein the coupling comprises coupling one or more fins to one or more control rods coupled to the swash plate.

20. The method of claim 18, further comprising displacing the swash plate along a longitudinal axis with a roll actuator to affect a change in the first rate.

21. The method of claim 20, wherein the displacing the swash plate does not substantially affect the orientation of the pitch actuator with the swash plate.

22. The method of claim 18, wherein the object is a missile.

23. A method for controlling an object spinning at a first rate in a first direction, comprising:

coupling one or more guidance members of the object to a swash plate;

spinning a rotor coupled to the swash plate in a second direction opposite the first direction at a second rate;

tilting the swash plate in a first tilt direction about a longitudinal axis with a pitch actuator coupled to the rotor to affect a first change in pitch of the object;

spinning the rotor in the second direction at a third rate to adjust the first tilt direction to a second tilt direction about the longitudinal axis; and tilting the swash plate in the second tilt direction with the pitch actuator to affect a second change in pitch of the object.

24. The method of claim 23, wherein the coupling comprises coupling one or more fins to one or more control rods coupled to the swash plate.

25. The method of claim 23, further comprising displacing the swash plate along a longitudinal axis with a roll actuator to affect a change in the first rate.

26. The method of claim 25, wherein the displacing the swash plate does not substantially affect the orientation of the pitch actuator with the swash plate.

27. The method of claim 23, wherein the object is a missile.

* * * * *

UNITED STATES PATENT AND TRADEMARK OFFICE

CERTIFICATE OF CORRECTION

PATENT NO. : 6,360,987 B1
DATED : April 10, 2002
INVENTOR(S) : Sallee at al

It is certified that error appears in the above-identified patent and that said Letters Patent is hereby corrected as shown below:

Title page,
Item [75], please delete "Sallaee" and insert -- Sallee -- therefor.
Item [73], please delete "Bae" and insert -- BAE -- therefor.

Signed and Sealed this

Eighteenth Day of June, 2002

*Attest:*

*Attesting Officer*

JAMES E. ROGAN
*Director of the United States Patent and Trademark Office*